US011227568B2

(12) United States Patent
Balsereit

(10) Patent No.: US 11,227,568 B2
(45) Date of Patent: Jan. 18, 2022

(54) SOUND POST SYSTEM

(71) Applicant: DIASTRAD E. K., Brühl (DE)

(72) Inventor: Willi-Paul Balsereit, Brühl (DE)

(73) Assignee: DIASTRAD E. K., Brühl (DE)

( * ) Notice: Subject to any disclaimer, the term of this patent is extended or adjusted under 35 U.S.C. 154(b) by 0 days.

(21) Appl. No.: 16/970,553

(22) PCT Filed: Feb. 5, 2019

(86) PCT No.: PCT/EP2019/052758
§ 371 (c)(1),
(2) Date: Aug. 17, 2020

(87) PCT Pub. No.: WO2019/162081
PCT Pub. Date: Aug. 29, 2019

(65) Prior Publication Data

US 2021/0118413 A1 Apr. 22, 2021

(30) Foreign Application Priority Data

Feb. 23, 2018 (DE) ..... 20 2018 000 990.3

(51) Int. Cl.
*G10D 3/02* (2006.01)
*G10D 3/22* (2020.01)

(52) U.S. Cl.
CPC ..... *G10D 3/02* (2013.01); *G10D 3/22* (2020.02)

(58) Field of Classification Search
CPC ..... G10D 3/02; G10D 3/22
See application file for complete search history.

(56) References Cited

U.S. PATENT DOCUMENTS

| | | | |
|---|---|---|---|
| 878,124 | A | 2/1908 | D'Armon |
| 2,145,237 | A | 1/1939 | Eberhart |
| 2,162,595 | A | 6/1939 | Virzi |
| 5,208,408 | A | 5/1993 | Cave |

FOREIGN PATENT DOCUMENTS

| | | | | |
|---|---|---|---|---|
| DE | 102014009336 | B3 | 3/2015 | |
| DE | 202017105759 | U1 | 9/2017 | |
| DE | 202017105759 | U1 * | 9/2017 | ..... G10D 3/04 |

* cited by examiner

*Primary Examiner* — Kimberly R Lockett
(74) *Attorney, Agent, or Firm* — Harness, Dickey & Pierce, P.L.C.

(57) ABSTRACT

In order to produce a sound post system that is easy to deploy, is position-variable and can be adjusted with little technical outlay even by less technically skilled operators, the disclosure proposes a sound post system that comprises a sound post and an adjustment tool, wherein the sound post comprises a tube that has a contact element hinged to one end of the tube and, at the other end of the tube, a screw mechanism with a support element, said screw mechanism being formed by a mating thread on the tube and a threaded component connected to said support element, wherein a further hinged contact element is disposed on the side of the support element that faces away from the tube and, by actuating the screw mechanism, the distance between said two contact elements can be varied, both the support element and the tube comprising radial holes for the introduction of torque forces, and the adjustment tool comprising a rod for inserting into a radial hole, and a handle that is connected to said rod.

17 Claims, 1 Drawing Sheet

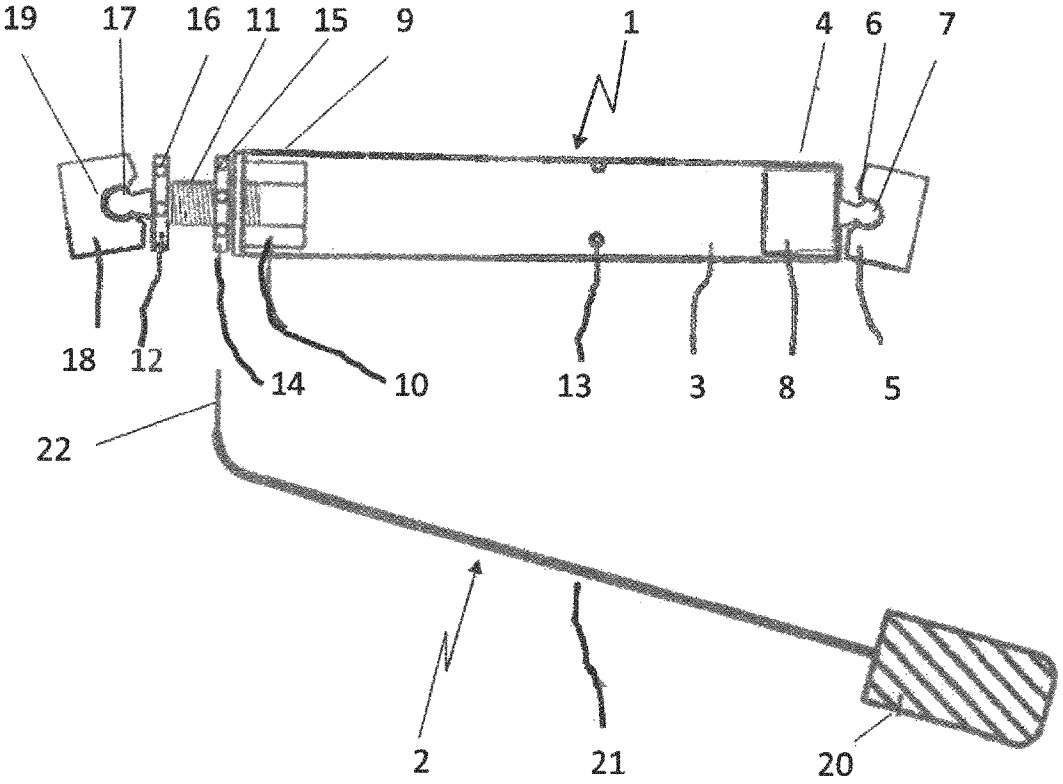
7
6
4
1
9
15
11
16
17
19
5
8
3
13
10
14
12
18
22
20
21
2

SOUND POST SYSTEM

CROSS-REFERENCE TO RELATED APPLICATIONS

This application is a U.S. National Phase under 35 U.S.C. 371 of International Application No. PCT/EP2019/052758, filed on Feb. 5, 2019, which claims the benefit of German Patent Application No. 20 2018 000 990.3, filed on Feb. 23, 2018. The entire disclosures of the above applications are incorporated herein by reference.

FIELD

The present disclosure relates to a sound post system comprising a sound post and an adjustment tool.

BACKGROUND

This section provides background information related to the present disclosure which is not necessarily prior art.

Such sound post systems are used for the fine tuning of string instruments.

The sound of a string instrument is essentially determined by the geometry of the individual components and their masses to each other. Each individual component has its specific function on all other components which in turn interact with this individual and all other components.

One of these components is the so-called sound post. The sound post as a mandatory component of each string instrument with a wooden belly developed in European latitudes has a particularly important position in the list of components of a string instrument, among others by the following functions:

- It supports the belly in its longitudinal oscillation, which is stimulated by the transverse oscillations (whiplash effect) of the string and transmitted by the asymmetrically acting bridge, at a certain distance behind the bridge (towards the tailpiece). Any change in length or position of the sound post, no matter how small, causes a significant change in sound.
- Due to the spherical shape of the two inner sides of the sound plates "belly" and "back", they form an irregular circle in cross section, the sound post representing a tangent which, due to the different radii and distances at each point, can actually fit only at one location.
- Due to a change in humidity conditions, which have a volume-changing effect on the wood of stringed instruments when ignored, the geometrical conditions of the instrument also change. The result is a changed fit, since the sound post cannot cope with this change with regard to its length.

The decisive relationship of the two head ends of a sound post to the inner sides of the instrument "belly and back" is only sufficient if the following conditions are met:

a) Belly and back fit of the sound post head ends stand "air"-tight on the entire contact area (inner sides of "belly" and "back") and with equal pressure at all head end points on the inner sides of the instrument.
b) The selected location of the sound post on back and belly allows the oscillations in the desired tone color.
c) The support pressure of the sound post between back and belly, which is dependent on the respective length of the sound post, allows the signal passage rate that leads to the desired response behavior and amplitude development of the instrument.

Due to the radius/tangent ratio of the sound post, every change of location requires a new length determination according to the above-mentioned points a)-c).

Once the supposedly right location has been found, the subsequently required length adjustment may, however, result in tonal changes that need to be corrected again by corrections of the location. Here, too, the condition of a) must be met, which means that the sound post loses length.

Should this length fall below the required length, the production of a new sound post is unavoidable.

To meet these reciprocal conditions between sound optimization and fit is usually a rather time-consuming procedure, the success of which depends largely on the professional experience of the user.

For this reason, adjustable sound posts and sound post systems which allow a readjustment of the sound post have been proposed in prior art.

U.S. Pat. No. 2,145,237 discloses a sound post consisting of an adjustment system which automatically adjusts the length of the sound post by means of a guided compression spring and in which the respective inclinations caused by the irregular circle radii of the interior belly and interior back must be adapted in each case. This is a constraint that can lead to an actual fit at only one location without adjustment, but not at all the other conceivable locations.

U.S. Pat. No. 5,208,408 discloses an adjustable sound post in which fixation is to be achieved solely by friction inhibition using suitable materials and thread pitches. Extreme vibrations of this component result in self-adjustments. Further, the "place of fixation" means that the overall height does not always have to correspond to the internal dimensions of the respective string instrument. Accordingly, the sound post is not stable in place. Adjustments to different heights, for example of flat modern instruments on the one hand, which often have sound post lengths that differ by several centimeters from that of older, higher instruments, on the other hand, can only be successfully adapted by replacing the entire component. The same applies to a sound post according to DE 10201400933663.

U.S. Pat. No. 878,124 discloses length adjustability of the sound post in a conceivably consistent form in that it (the sound post) is led outwards through a hole in the back and through a nut attached to the rim of the hole and there, at the end which is designed as a set screw, creates the distance between the belly and the back in an adjustable manner. The oscillation excitation in a longitudinal propagation which is specific to a string instrument is thus not possible when scanning the bridge foot. Further, the instrument is altered, and the perforation of the back (and in this case also of the belly) meets with resistance from most instrument owners.

DE 202017105759 discloses an adjustable sound post with variable positioning, automatic head-end adaption and length adjustment in the mounted condition. However, six different elements are required for mounting and adjustment: a plastic rod, a plastic ring, a plastic nut, an adjusting open-end wrench, two magnets.

After mounting, a relatively large adjusting wheel on the component remains inside the string instrument. This leads to an increase in weight and influences the sound behavior. It is generally undesirable for adjustment aids to remain inside the instrument.

SUMMARY

This section provides a general summary of the disclosure, and is not a comprehensive disclosure of its full scope or all of its features.

In view of prior art as described above, it is an object of the present disclosure to provide a sound post system that can be mounted in a simple way, varied in terms of location and can be adjusted with little technical effort even by persons with little technical training.

For the technical solution a sound post system with the features of claim 1 is proposed. Further advantages and features will become apparent from the subclaims.

According to the disclosure, the sound post system comprises a sound post and an adjustment tool. The sound post comprises a tube. "Tube" in terms of the present disclosure means a continuous tube or bar with a central hole or also only with internally drilled ends. Normally, the tube can be made of any material. According to an advantageous proposal of the disclosure, the tube is made of carbon fiber or comprises carbon fiber material, at least partially. This means that signal passage rates and inertias are used which have a positive effect on the behavior of the instrument. Different materials have different densities and can thus produce a wide range of sound variations.

Also, "tube" in terms of the disclosure does not necessarily means that it has a cylindrical outer contour. The design can also be adapted to the desired tone color and to the sound behavior of the string instrument.

According to the disclosure, the intermediate component of the sound post, called the tube, has a contact element hinged to one end of the tube. The contact element can be supported relative to the tube by a ball bearing. For this purpose, one proposal of the disclosure is to attach a ball bearing to the end of the sound post. This can be done by gluing, gluing in, putting over, screwing on or the like. The ball bearing element has a flange with a ball element directed away from the tube. According to the proposal of the disclosure, the contact element has a ball socket for receiving the ball. This can have an undercut, for example, so that the contact element can be clipped onto the ball. Advantageously, according to one proposal of the disclosure, the contact element is exchangeable. In this manner, the contact element can be fabricated from any materials and can be adapted to any surface contours. Also, according to an advantageous proposal of the disclosure, the contact element can have an at least partially elastic surface in order to be able to attach well to different surfaces inside a string instrument. At the other end of the sound post which is called a tube, a screw mechanism is arranged. In general, screw mechanisms in terms of the disclosure are sub-assemblies comprising a threaded component, such as a threaded spindle or a threaded tube, interacting with a mating thread which is displaceable but not rotatably mounted relative to it, hence a spindle nut or a mating tube. In this manner, the rotational movement of one element is translated into a longitudinal movement.

At the free end of the screw mechanism, a supporting element is provided which in turn has hinged to it a further contact element. For this second contact element, the same applies as for the first one. It can be supported by a ball bearing, can consist of different materials and can be arranged to be attached to any contact surfaces inside the string instrument.

Actuation of the screw mechanism changes the distance between the two contact elements.

According to the disclosure, such a design is characterized in particular in that both the supporting element and the tube have radial holes. These serve to introduce torque forces into both elements. If an adjustment tool belonging to the system is used in radial holes of the tube on the one hand and in radial holes of the supporting element on the other hand, by inserting a rod belonging to the adjustment tool into a radial hole, a torque can be exerted via a handle connected to the rod. In this manner, a relative movement of said two elements of the screw mechanism can be produced with the effect that said two contact elements are moved away from or towards each other. In this manner, the sound post is automatically adjusted in length and is braced against the opposing inner surfaces of the string instrument at the intended place inside the instrument. The strength of the bracing then influences the sound behavior.

The screw mechanism can be produced in various ways. For example, an internal thread can be formed inside of the one tube end by inserting a threaded sleeve. Alternatively, an external thread can be provided on the tube by attaching a sleeve or, in both cases, by cutting the thread directly into the tube.

Depending on whether an internal thread or an external thread are formed, the mating element which is connected to the support element is a threaded rod, a bolt or a threaded sleeve for example.

The pitch of the thread is determined in each case in accordance with instrument-technical aspects.

According to a further advantageous proposal of the disclosure, the supporting element is disc-shaped, possibly also in the form of a nut. It is non-rotatably connected to the threaded component so that a torque can be exerted via the support element by inserting the rod into the radial hole. The counter torque is produced by a rod of an adjustment tool inserted into the radial holes of the tube and by exerting a counter force.

Advantageously, the screw mechanism comprises a locking unit, according to an advantageous proposal of the disclosure in the form of a lock nut. According to a further advantageous proposal of the disclosure, said lock nut can also have one or more radial holes so that it can be loosened or fixed using the same adjustment tool.

To be able to introduce correspondingly good torques or counter-torques into the tube, the disclosure proposes that mutually aligned radial holes are made, i.e. through-holes that actually or virtually cross the longitudinal centerline of the tube. It is possible in this way to optimally apply very fine torques.

Advantageously, the adjustment tools are provided with a handle and guide rod attached to it. A rod is arranged at the end of guide rod that can be inserted both into the radial holes of the tube and also of the support element and into the lock nut if necessary. Advantageously, the rod can be adjustable with respect to the guide rod.

In contrast to prior art, the new disclosure presented here merely needs two handle-gripped bent wires and is therefore much easier to handle in terms of operability. It is also not necessary to leave adjustment elements inside the instrument.

This results in considerable advantages compared to prior art and conventional designs. Adjustment work which possibly requires half a day is thus reduced to only a few minutes. Damage to the inside of the belly and back is practically impossible and there is no damage due to tangential tilting as with the traditional wooden sound post or in the case of holes. The user requires no special professional qualification as a string instrument maker. Every musician can practically adjust his instrument after little practice.

The disclosure differs from prior art in decisive details. The selection of the material of the end pieces or contact elements supported by ball bearings is arbitrary as long as it allows sufficient static friction, and is added to the component as a variant. Different materials lead to different attenuations and signal passage rates. The result is a different sound structure in each case. A ball head is described here as an example which is made of sapphire and embedded in a carbon fiber end piece, in contrast to an aluminum ball head which is embedded in a wooden end piece. Both versions cannot have the same signal transmission rates and have completely different sound characteristics.

Furthermore, the material (carbon fiber, wood, metal, etc.) and the design (tube or rod) for the connecting part between the two adjustment elements can be selected as required. Different materials have different densities, i.e. signal transmission rates and different moments of inertia. A wide range of sound variations can be produced in this way.

This variety of options makes it possible to meet the requirements of all conceivable string instruments and the different sound visions of the musicians.

In addition, installation and adjustment are extremely easy to perform.

After all, once set, the result is permanent.

After the component has been installed and adjusted as described above, it is suitable to remain in a string instrument as a fixed part thereof and without any time limit, and it is also suitable as a tool for temporary use during the adaptation of a wooden sound post according to traditional methods to avoid damage to the belly and back.

The mounting and adjustment tool consists of a wire that is bent at its end facing the component and has a different wire thickness adjusted to the instrument (1.5 mm for a violin and viola, 2 mm for a cello, and 3 mm for a double bass) and terminates at the other end by a wooden handle to which it is firmly connected by a guide rod.

The tube is preferably designed with different diameters for different string instruments, for example approx. 6 mm for a violin and viola, approx. 10 mm for a cello, approx. 18 mm for a double bass.

For the contact elements, a ball is respectively attached to a support (4 mm diameter for a violin and viola, 5 mm for a cello, and 10 mm for a double bass), on which the ball as a seat for the contact element (wood or other material) having the corresponding ball hole forms the end of the component.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

The disclosure provides a very practice-oriented, easily made and easy-to-use sound post system. Further advantages and features will become apparent from the following description with reference to the attached drawings in which FIG. 1 shows a schematic representation of one embodiment of a sound post and an adjustment tool.

Corresponding reference numerals indicate corresponding parts throughout the several views of the drawing.

DETAILED DESCRIPTION

Example embodiments will now be described more fully with reference to the accompanying drawing.

The embodiment of a sound post 1 shown in FIG. 1 comprises a tube 3 at the end 4 of which a plug 8 is inserted. This carries the attached ball 7. The plug 8 is dimensioned in such a way that it cannot be pushed into the tube, e.g. by a mounting flange. The contact element 5 is attached to the ball 6 by the ball socket 7 being clipped onto the ball 6. The contact element 5 can thus be pivoted and adapted to almost any surface position. It is also exchangeable to vary shape, size, material and the like.

At the other end 9 of the tube 3, a threaded sleeve 10 is inserted in the design example shown, which also cannot be moved relative to the tube 3 due to a mounting flange. A threaded rod 11 is screwed into the internal thread of the threaded sleeve 10 and firmly connected at its free end to a support disc 12. This support disc in turn supports a ball 17 to which the contact element 18 with its ball socket 19 is attached. The contact element 18 is designed in the same way as the contact element 5. It goes without saying that the shapes, materials and sizes of the two contact elements 5 and 18 vary and can also be different from one another.

For the purpose of adjustment, radial holes 16 are made in the support disc 12. If the support disc 12 is now turned, the threaded rod 11 is screwed into or out of the threaded sleeve 10, depending on the direction of rotation, provided the tube 3 is held against it.

For the purpose of operation, the adjustment tool 2 is formed with a handle 20, preferably of wood, arranged at one end of the guide rod 21. At the free end of the guide rod 21 the rod 22 is formed, which is suitably angled in the illustrated embodiment. The rod 22 has a diameter enabling its insertion into the radial holes 13 of the tube and/or 16 of the support disc. If the adjustment tool 2 is now applied in such a way that its rod 22 passes through the radial holes 13 of the tube 3 and if a second adjustment tool 2 is applied at the radial holes 16 of the support disc 12 and if corresponding torques are applied, the threaded rod 11 is rotated relative to the threaded sleeve 10 that is arranged fixed against rotation in the tube 3. In this way, the distance of the contact elements 5 and 18 relative to each other can be adjusted.

For the purpose of fixation, a lock nut 14 is provided which also has radial holes 15 and can be rotated in a corresponding manner after adjustment in order to caulk the threaded rod 11 relative to the free edge at the end of the tube 3 or the mounting flange of the threaded sleeve 10.

Mounting:

The mounting of a sound post of the above-described design is very easy:

1) The length of the sound post is determined using an inside calliper (common tool for instrument making). Alternatively, the wooden sound post can be used for approximate length determination. The length is the distance of the outer surfaces of the contact elements 5 and 18 to each other.
2) If necessary, the tube 3 is cut length.
3) The plug 8 is inserted at one end.
4) The threaded sleeve 10 is inserted at the other end.
5) The threaded rod 11 as well as the contact elements 5 and 18 are attached.
6) The length is roughly preset.
7) The mounting tool 2 (1.5 mm for a violin, viola and cello, 3 m for a double bass)—angled rod 22 with a handle 20—is inserted into the radial hole 13 of the tube 3.
8) The heavy lower part holds the sound post 1 in the mounting position by ceasing swinging, is inserted into the f-hole of the instrument, positioned on the floor and pulled against the arch of the belly.

The mounting of the component is thus completed.

Adjustment:

The adjustment of the sound post described above is very easy and allows a precision never seen before.

The mounting tool 2 described above is used and is inserted through the f-hole of the bowed instrument into one of the holes 15 of the lock nut 14. Using a second adjustment tool 2 of the same design, the lock nut 14 is separated from the tube 3 by turning it counterclockwise.

This makes the threaded rod 11 freely rotatable so that the threaded rod 11 can be turned in the desired direction (left for thread extension, right for thread shortening) by inserting the tool 2 into the existing radial holes 16 of the support disc 12.

At the same time, the tube 3 is held by a rod 22 which is inserted and held in the radial holes 13 of the tube 3.

The change in length of the component can be read from the number of holes by which further rotation has taken place:

there are 6 radial holes, the thread pitch is 0.75 mm/U for the double bass variant consequently, the change in length of the component is 0.125 mm for each hole that has been moved.

In case of doubt, it is possible to make a measurement before and after each change in length using the inside calliper.

Of course, this before and after measurement is also possible from outside using a corresponding slide gauge.

In practice, the adjustment width is mainly set by ear as regards sound, for example when a musician is travelling with his instrument.

Thereafter, the lock nut 14 is again tightened and the adjustment process thus completed.

The above-described embodiment merely serves the purpose of explanation and is no way limiting.

The foregoing description of the embodiments has been provided for purposes of illustration and description. It is not intended to be exhaustive or to limit the disclosure. Individual elements or features of a particular embodiment are generally not limited to that particular embodiment, but, where applicable, are inter-changeable and can be used in a selected embodiment, even if not specifically shown or described. The same may also be varied in many ways. Such variations are to be regarded as a departure from the disclosure, and all such modifications are intended to be included within the scope of the disclosure.

The invention claimed is:

1. A sound post system, comprising a sound post and an adjustment tool, wherein the sound post comprises a tube that has a contact element hinged to one end of the tube and, at the other end of the tube, a screw mechanism with a support element, said screw mechanism being formed by a mating thread on the tube and a threaded component connected to said support element, wherein a further hinged contact element is disposed on the side of the support element that faces away from the tube and wherein, by actuating the screw mechanism, the distance between said two contact elements can be varied, wherein both the support element and the tube comprise radial holes for the introduction of torque forces, and the adjustment tool comprises a rod for inserting into a radial hole, and a handle that is connected to said rod.

2. The sound post system according to claim 1, wherein the tube is made of carbon fiber.

3. The sound post system according to claim 1, wherein the mating thread on the tube is an internal thread.

4. The sound post system according to claim 3, wherein the internal thread is formed in a threaded sleeve inserted in and fixed to said tube.

5. The sound post system according to claim 1, wherein the mating thread on the tube is an external thread.

6. The sound post system according to claim 1, wherein the threaded component connected to the support element is a threaded rod.

7. The sound post system according to claim 1, wherein the threaded component connected to the support element is a threaded bolt.

8. The sound post system according to claim 1, wherein the threaded component connected to the support element is a threaded sleeve.

9. The sound post system according to claim 1, wherein the support element is disc-shaped.

10. The sound post system according to claim 1, wherein the support element is a nut.

11. The sound post system according to claim 1, wherein the screw mechanism comprises a locking unit.

12. The sound post system according to claim 11, wherein the locking unit is a lock nut.

13. The sound post system according to claim 12, wherein the lock nut has radial holes.

14. The sound post system according to claim 1, wherein the radial holes on the tube comprise at least a pair of mutually aligned holes.

15. The sound post system according to claim 1, wherein the contact elements are supported by ball bearings with respect to the tube.

16. The sound post system according to claim 1, wherein the contact elements are arranged such that they can be exchanged.

17. The sound post system according to claim 1, wherein the handle of the adjustment tool comprises a handle and a guide rod at whose end facing away from said handle the rod is arranged.

* * * * *